United States Patent [19]

Morrissey

[11] 4,406,755

[45] Sep. 27, 1983

[54] BRIGHT PALLADIUM ELECTRODEPOSITION

[75] Inventor: Ronald J. Morrissey, Cranston, R.I.

[73] Assignee: Technic Inc., Providence, R.I.

[21] Appl. No.: 355,334

[22] Filed: Mar. 8, 1982

[51] Int. Cl.[3] ..... C25D 3/50

[52] U.S. Cl. ..... 204/47

[58] Field of Search ..... 204/43 N, 47

[56] References Cited

U.S. PATENT DOCUMENTS 3,267,098 8/1966 Cope ..... 204/47 X 3,458,409 7/1969 Hayashi et al. ..... 204/47 X 3,972,787 8/1976 Nobel et al. ..... 204/47

4,278,514 7/1981 Morrissey ..... 204/47

*Primary Examiner*—G. L. Kaplan

*Assistant Examiner*—Nam X. Nguyen

*Attorney, Agent, or Firm*—Ostrolenk, Faber, Gerb & Soffen

[57] ABSTRACT

A palladium electroplating solution containing the palladium in the form of a soluble organopalladium complex of an inorganic palladium salt, an organic polyamine complexing agent, a cyclic imide and a nitrogen containing heterocyclic compound having a six-membered ring.

12 Claims, No Drawings

BRIGHT PALLADIUM ELECTRODEPOSITION

BACKGROUND OF THE INVENTION

In U.S. Pat. No. 4,278,514 I disclosed an electroplating solution for the deposition of palladium containing said palladium in the form of a soluble organopalladium complex formed from an inorganic palladium salt and an organic polyamine complexing agent having from 2 to about 8 carbon atoms and from 2 to about 5 amino groups; said solution having a pH from about 3–7, and said solution containing about 1–50 grams per liter of a cyclic organic imide of formula

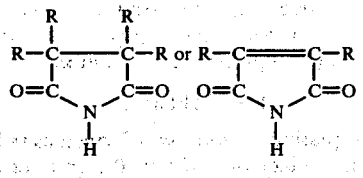

in which each R is independently selected from the group consisting of hydrogen, alkyl of 1–5 carbon atoms, or alkoxy of 1–5 carbon atoms. I also disclosed that in the electroplating solution hereinabove described, a further improvement in brightness of the deposit could be obtained by including in the solution a quantity of about 1–50 grams per liter of organic polyamine complexing agent beyond that forming a part of the soluble organopalladium complex.

Physical, mechanical and electrical properties of palladium electrodeposits from solutions as described in U.S. Pat. No. 4,278,514 have been measured and are published in the literature [R. J. Morrissey, *Plating and Surface Finishing,* 67, 44 (Dec. 1980)]. The deposits are subject to microcracking, the extent of which can be reduced by increasing the temperature of the plating solution. This, however, causes a concurrent loss of deposit brightness. X-ray diffraction studies show the deposits to be strongly (110) oriented under most plating conditions. [Note: "110" and "111" refer to Miller Indices. B. D. Cullity, *Elements of X-ray Diffractions,* Addison-Wesley, Mass. 1956].

Although the occurrence of microcracking is quite common in palladium electrodeposits, it is in general considered to be undesirable. It may also be noted that the atomic arrangement in metallic palladium is face-centered cubic. The slip plane, that is, the crystallographic plane in which the atomic layers of a crystal can slide over each other with minimum friction, is the (111) plane in face-centered cubic crystals. Deposits oriented with the slip plane parallel to the substrate surface are generally superior in resistance to sliding friction and abrasive wear than those otherwise oriented. On this basis one would expect that, other things such as deposit hardness being equal, the resistance to abrasive wear of a (110) oriented palladium electrodeposit such as is ordinarily deposited from electroplating solutions as described in U.S. Pat. No. 4,278,514 would be inferior to that of a (111) oriented deposit.

The foregoing comments notwithstanding, many aspects of the chemistry of electroplating solutions for palladium as described in U.S. Pat. No. 4,278,514, specifically freedom from added ammonium ion, a pH range from about 3–7, and the use of a soluble organopalladium complex as the source of palladium, remain highly desirable in that they permit the deposition of palladium directly onto substrates including nickel, copper, and alloys thereof without requiring the use of an intermediate strike coating.

Accordingly, it is an object of this invention to provide a formulation for the electroplating of palladium, said formulation being free of added ammonium ion, and of a pH range so as to be applicable for plating palladium deposits onto substrates including nickel, copper, and alloys thereof without requiring the application of a prior strike; and said formulation being suitable for plating palladium deposits which are free of microcracking, of very high brightness, and of (111) preferred crystal orientation. This and other objects of the invention will become apparent to those skilled in the art from the following detailed description.

SUMMARY OF THE INVENTION

This invention relates to palladium electroplating solutions and the use thereof, and more particularly to aqueous solutions containing palladium complexed with an organic polyamine, and also containing both a cyclic organic imide and a nitrogen-containing heterocyclic organic compound at least one nitrogen of which is incorporated into a six-membered ring.

DESCRIPTION OF THE INVENTION

It has been found that in a palladium electroplating solution as described in claims 1–5 of U.S. Pat. No. 4,278,514, that is, an aqueous electroplating solution of pH from about 3–7 containing palladium in the form of a soluble organopalladium complex of an inorganic palladium salt and an organic polyamine complexing agent having from 2 to about 8 carbon atoms and from 2 to about 5 amino groups, said solution also containing about 1–50 grams per liter of a cyclic organic imide of formula

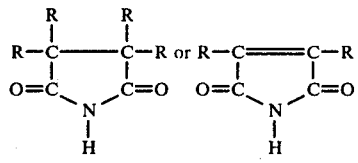

in which each R is independently selected from the group consisting of hydrogen, alkyl of 1–5 carbon atoms, or alkoxy of 1–5 carbon atoms; addition to said solution of a quantity corresponding to about 0.005–1 grams per liter (preferably 0.01–1.0 grams per liter) of a nitrogen containing organic heterocyclic compound at least one nitrogen of which is incorporated into a six-membered ring produces a very marked improvement in brightness of the electrodeposit, eliminates the occurrence of microcracking, and causes the deposit to have a (111) preferred crystal orientation. It is important to note that these effects, particularly freedom from microcracking and (111) preferred orientation of the deposit, occur only if *both* the cyclic imide and the nitrogen-containing heterocyclic compound are present simultaneously in the electroplating solution. The presence of either compound singly yields only (110) oriented, microcracked deposits.

Suitable nitrogen-containing heterocyclic compounds for the purposes of this invention comprises primarily aromatic compounds related to pyridine, pyrimidine, and pyrazine, although aliphatic compounds related to piperidine and piperazine show similar but less marked effects. Particular strong effects are shown by those compounds in which at least one nitrogen incorporated in the six-membered heterocyclic ring is quaternarized by reaction with the alkali metal salt of 2-chloroethane sulfonate, propane sultone, butane sultone, isopentane sultone or similar compound to form the corresponding sulfobetaine derivative. It will be shown in subsequent examples that pyridinium propyl sulfobetaine, which is the reaction product of pyridine with 1,3 propane sultone, is effective for the purposes of this invention in far lower concentration than is pyridine itself.

Specifically, then, nitrogen-containing heterocyclic compounds which are suitable for the purposes of this invention include but are not necessarily limited to, pyridine, $\alpha$, $\beta$, and $\gamma$-picolines, picolinic acid, nicotinic acid isonicotinic acid, nicotinamide, isonicotinamide, isoniazid, nicotinyl alcohol, nicotine, pyridine 3-sulfonic acid, 3-pyridineacetic acid, 2,2' dipyridyl, 4,4' dipyridyl, quinoline, pyrimidine, pyrazine, pyrazine carboxylic acid, and pyrazinamide; also piperidine, nipecotic acid, isonipecotic acid, and piperazine; and particularly including the reaction products of these compounds with 2-chloroethane sulfonate, propane sultone, butane sultone, and isopentane sultone. It will be apparent to those skilled in the art that other derivatives of these and similar compounds may prove suitable to a greater or lesser degree for the purposes of this invention.

For the purposes of this invention an excess of organic polyamine complexing agent, as described in Claims 6, 7, and 8 of U.S. Pat. No. 4,278,514, is not required or employed.

In order to illustrate the present invention, some examples are given below:

EXAMPLE I

Sufficient water was employed to form one liter of a palladium electroplating solution containing the following:

8 grams palladium in the form of palladium bis (ethylenediamine sulfate)
120 grams monopotassium phosphate
15 grams succinimide
0.36 grams pyridine.

The solution pH was adjusted to 5.8 by adding potassium hydroxide. A test panel was plated in this solution in a Hull cell for two minutes at one ampere at 60° C. A deposit of palladium was obtained which was mirror-bright, haze-free and microcrack-free at current densities from near zero to about 40 mA/cm$^2$. Analysis of the deposit by X-ray diffraction indicated (111) preferred orientation.

EXAMPLE II

An electroplating solution was formed as in Example I except that in place of pyridine 0.25 gram of nicotinamide was employed. A test panel was plated in the solution in a Hull cell for two minutes at one ampere at 60° C. A deposit of palladium was obtained which was mirror-bright, haze-free and microcrack-free at current densities from near zero to about 40 mA/cm$^2$. Analysis of the deposit by X-ray diffraction indicated (111) preferred orientation.

EXAMPLE III

An electroplating solution was formed as in Example I except that in place of pyridine, 0.067 grams of pyridinium propyl sulfobetaine was employed. A test panel was plated in this solution in a Hull cell for two minutes at one ampere at 60° C. A deposit of palladium was obtained which was mirror-bright, haze-free and microcrack-free at current densities from near zero to about 40 mA/cm$^2$. Analysis of the deposit by X-ray diffraction indicated (111) preferred orientation.

EXAMPLE IV

An electroplating solution was formed as in Example I except that in place of pyridine, 0.1 gram of pyridinium ethyl sulfobetaine was employed. A test panel was plated in this solution in a Hull Cell for two minutes at one ampere at 60° C. A deposit of palladium was obtained which was mirror-bright, haze-free and microcrack-free at current densities from near zero to about 40 mA/cm$^2$. Analysis of the deposit by X-ray diffraction indicated (111) preferred orientation.

EXAMPLE V

An electroplating solution was formed as in Example I except that in place of pyridine, 0.1 gram of quinolinium propyl sulfobetaine was employed. A test panel, was plated in this solution in a Hull cell for two minutes at one ampere at 60° C. A deposit of palladium was obtained which was mirror-bright, haze-free and microcrack-free at current densities from near zero to about 30 mA/cm$^2$. Analysis of the deposit by X-ray diffraction indicated (111) preferred orientation.

EXAMPLE VI

Sufficient water was employed to form one liter of an electroplating solution containing the following:

8 grams palladium in the form of palladium bis (1,2 propanediamine) sulfate
75 grams potassium citrate
75 grams citric acid
15 grams succinimide
0.133 grams pyridinium propyl sulfobetaine.

The solution pH was 4.0. A test panel was plated in this solution in a Hull cell for two minutes at one ampere at 60° C. A deposit of palladium was obtained which was mirror-Bright, haze-free and microcrack-free at current densities from near zero to about 35 mA/cm$^2$. Analysis of the deposit by X-ray diffraction indicated (111) preferred orientation.

EXAMPLE VII

An electroplating solution was formed as in Example IV, except that the palladium employed was in the form of palladium bis (1,3 propanediamine) sulfate. A test panel was plated in this solution in a Hull cell for two minutes at one ampere at 60° C. A deposit of palladium was obtained which was mirror-bright, haze-free and microcrack-free at current densities from near zero to about 30 mA/cm$^2$. Analysis of the deposit by X-ray diffraction indicated (111) preferred orientation.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A palladium electroplating solution of pH from about 3–7 containing palladium in the form of a soluble organopalladium complex of an inorganic palladium salt and an organic polyamine complexing agent having from 2 to about 8 carbon atoms and from 2 to about 5 amino groups; said solution being an aqueous solution; and said solution containing from 1 to about 50 grams per liter of a cyclic organic imide of formula

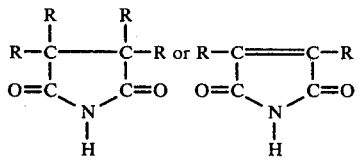

in which each R is independently selected from the group consisting of hydrogen, alkyl of 1–5 carbon atoms; and alkoxy of 1–5 carbon atoms; and said solution also containing about 0.005–1 gram per liter of at least one nitrogen-containing organic heterocyclic compound at least one nitrogen of which is incorporated into a six-membered ring.

2. The electroplating bath of claim 1 wherein said organic polyamine complexing agent is of the formula $H_2N-(CH_2-CH_2-NH_2)_x-(CH_2)_y-CH_2-CH_2-NH_2$ or

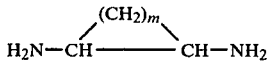

wherein x is 0–3, y is 0–4, and m is 3–4.

3. The electroplating solution of claim 2 wherein the complexing agent for palladium is selected from the group consisting of ethylenediamine, 1,2 propylenediamine, 1,3 propanediamine, 1,4 butanediamine, pentamethylenediamine, hexamethylenediamine, cyclohexanediamine, diethylenetriamine, triethylenetetramine, and tetraethylenepentamine.

4. The electroplating solution of claim 1 wherein the inorganic palladium salt is palladium sulfate.

5. The electroplating solution of claim 1 wherein the cyclic organic imide is succinimide or maleimide.

6. The electroplating solution of claim 1 wherein the nitrogen-containing organic heterocyclic compound is selected from the group consisting of pyridine, α-picoline, β-picoline, γ-picoline, picolinic acid, nicotinic acid, isonicotinic acid, nicotinamide, isonicotinamide, isoniazid, nicotinyl alcohol, nicotine, pyridine 3-sulfonic acid, 3-pyridineacetic acid, 2,2′ dipyridyl, 4,4′ dipyridyl, quinoline, pyrimidine, pyrazine, pyrazine carboxylic acid, pyrazinamide, piperidine, nipecotic acid, isonipecotic acid, piperazine, and the reaction products thereof with 2-chloroethane sulfonate, propane sultone, butane sultone or isopentane sultone.

7. The electroplating solution of claim 1 wherein the nitrogen-containing organic heterocyclic compound is a sulfobetaine.

8. The electroplating solution of claim 7 wherein the nitrogen-containing organic heterocyclic compound is selected from the group consisting of pyridinium ethyl sulfobetaine, pyridinium propyl sulfobetaine, pyridinium butyl sulfobetaine, and pyridinium isopentyl sulfobetaine.

9. A method of forming a bright palladium electroplate on a substrate comprising contacting said substrate with the electroplating solution of claim 1 and applying a current thereto.

10. The method of claim 9 wherein the substrate is contacted with the electroplating solution of claim 6.

11. The method of claim 9 wherein the substrate is contacted with the electroplating solution of claim 7.

12. The method of claim 9 wherein the substrate is contacted with the electroplating solution of claim 8.

* * * * *